United States Patent [19]

Carter

[11] 3,943,580

[45] Mar. 16, 1976

[54] THERAPEUTIC POOL SYSTEM

[76] Inventor: Don W. Carter, 19182 Hamden Lane, Huntington Beach, Calif. 92446

[22] Filed: Dec. 23, 1974

[21] Appl. No.: 535,157

[52] U.S. Cl. ..... 4/172.15; 4/177.17; 210/169

[51] Int. Cl.[2] ..... E04H 3/16; E04H 3/20

[58] Field of Search..... 4/172.15, 172.16, 172.17, 4/178, 180; 210/169

[56] References Cited

UNITED STATES PATENTS

| | | | |
|---|---|---|---|
| 3,247,968 | 4/1966 | Miller | 4/172.17 |
| 3,396,722 | 8/1968 | Lindberg | 4/180 |
| 3,756,220 | 9/1973 | Tehrani | 210/169 |

FOREIGN PATENTS OR APPLICATIONS

| | | | |
|---|---|---|---|
| 1,912,902 | 10/1970 | Germany | 4/172.15 |
| 10,865 | 5/1907 | United Kingdom | 4/172.18 |

*Primary Examiner*—Richard E. Aegerter
*Assistant Examiner*—A. J. Mirabito
*Attorney, Agent, or Firm*—Harvey C. Nienow

[57] ABSTRACT

A therapeutic pool system whereby a safer and more comfortable air circulation system is provided.

In detail, it comprises a fluid circulation system which circulates the fluid, usually water, from the pool through a skimmer, filter and heater back to the pool. In addition, there is an air circulation system whereby air is taken from above the water in the skimmer, intermixed with the circulating water and returned to the pool to provide a healthful, comfortable experience for people using the pool.

3 Claims, 4 Drawing Figures

THERAPEUTIC POOL SYSTEM

The present invention relates generally to pools for use by humans, and more particularly to such pools which employ air circulating systems.

Therapeutic pools have enjoyed increasing popularity within the past decade or two, so that today the installation and maintenance of such pools constitutes a relatively large industry. Pools usually have a fluid circulating system whereby the fluid is conducted from the pool through certain auxiliary pieces of equipment such as filters, heaters and the like, and is then returned to the pool. Also, therapeutic pools frequently have air circulation systems whereby air is injected into the pool beneath the fluid level therein, affording a massaging or rubbing action to persons within the pool.

Prior pool systems have had various objections. For instance, air circulation systems have brought air into the pool from outside thereof causing such air to be at a temperature greatly different from that of the fluid or water in the pool. The result has been considerable discomfort for persons within the pool.

other air circulation systems have taken air into the system from a point above the fluid level within the pool itself. This has caused an unsafe condition due to the suction or decreased pressure condition at such point. Individuals have been known to catch a finger or a part of their clothing in such a suction opening. Also, the air flow at such suction opening at the pool has been noisy and unsightly.

With the above objections in mind, the instant invention was effected to provide a more desirable therapeutic pool system.

It is an object of the present invention to provide a therapeutic pool system wherein the air added to the pool is at substantially the same temperature as the fluid therein.

Another object of the present invention is to provide a therapeutic pool system as characterized above wherein such temperature is obtained virtually automatically so that fluctuations in pool water temperature result in corresponding fluctuation of circulating air temperature.

A further object of the present invention is to provide a therapeutic pool system as characterized above wherein the suction end of the air circulation system is hidden from or not within the normal view of individuals using the pool.

An even further object of the present invention is to provide a therapeutic pool system as characterized above wherein a plurality of air circulating systems can be utlized in a single pool.

A still further object of the present invention is to provide a therapeutic pool system as characterized above which is simple and inexpensive to manufacture and which is rugged and dependable in operation.

The novel features which I consider characteristic of my invention are set forth with particularity in the appended claims. The device itself, however, both as to its organization and mode of operation, together with additional objects and advantages thereof, will best be understood from the following description of specific embodiments when read in connection with the accompanying drawings, in which:

Like reference characters indicate corresponding parts throughout the several views of the drawings.

Figure 1:
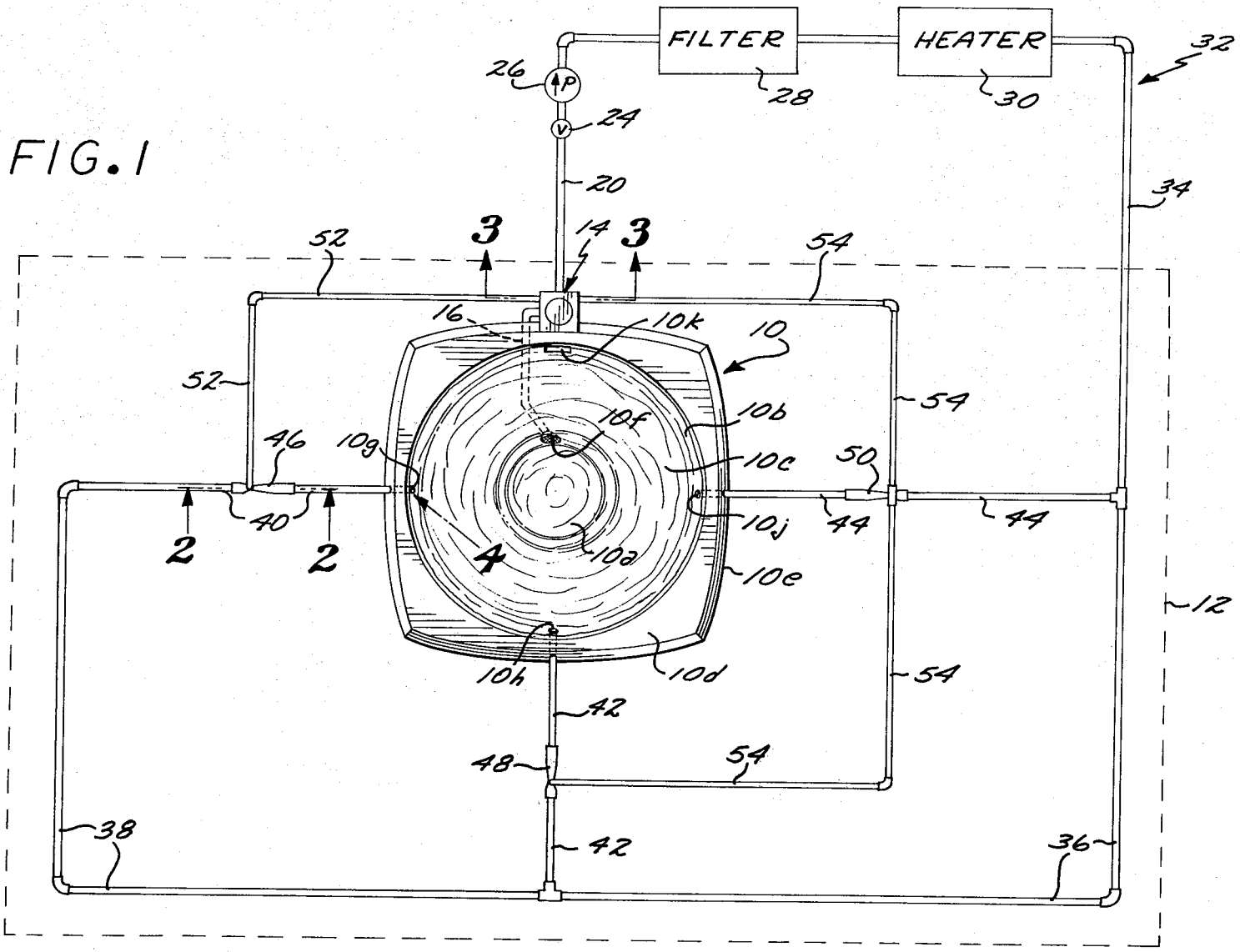
FIG. 1 is a top plan view, somewhat schematic, of a pool system according to the present invention.

Referring to FIG. 1 of the drawings, there is shown therein a pool 10 formed of any appropriate material such as plastic, metal, cementious material and the like. Such pool 10 may have any desired shape or size without in any way affecting the applicability of the instant invention.

The term "pool" as used herein, including the claims appended hereto, refers to pools of virtually every type and description, includiing what is referred to today as spas. That is, whereas swim pools have been very popular for many years, within the past several decades smaller pools have been provided, primarily for health and comfort reasons rather than to enable persons to swim considerable distances. Such spas are primarily to enable individuals to rest and relax in warmer water.

The pool 10 shown in FIG. 1 is formed of plastic and comprises a bottom wall 10*a* and a continuous side wall 10*b*. Such bottom wall may include a continuous circular seat 10*c* to enable individuals to sit and rest within the fluid of pool 10. A topmost surface 10*d* is provided about the upper marginal edge of side wall 10*b* and, for certain installations, a skirt 10*e* is provided about the entire pool.

The pool 10 may be placed above grade or ground level if desired, since the skirt 10*e* provides a finished appearance and an enclosure for the various components within the broken line 12 of FIG. 1. Such enclosure is formed by the continuous side wall 10*b*, top wall 10*d* and skirt 10*e*, but for purposes of illustration, FIG. 1 shows the various components in an expanded plan view.

The pool 10 shown in the drawings is formed with an outlet 10*f* and a plurality of inlets 10*g*, 10*h* and 10*j*. As will be readily understood by those persons skilled in the art, the number of inlets and outlets is not critical to the instant invention, nor is the placement thereof within the pool bottom and side walls 10*a* and 10*b* respectively.

Figure 3:
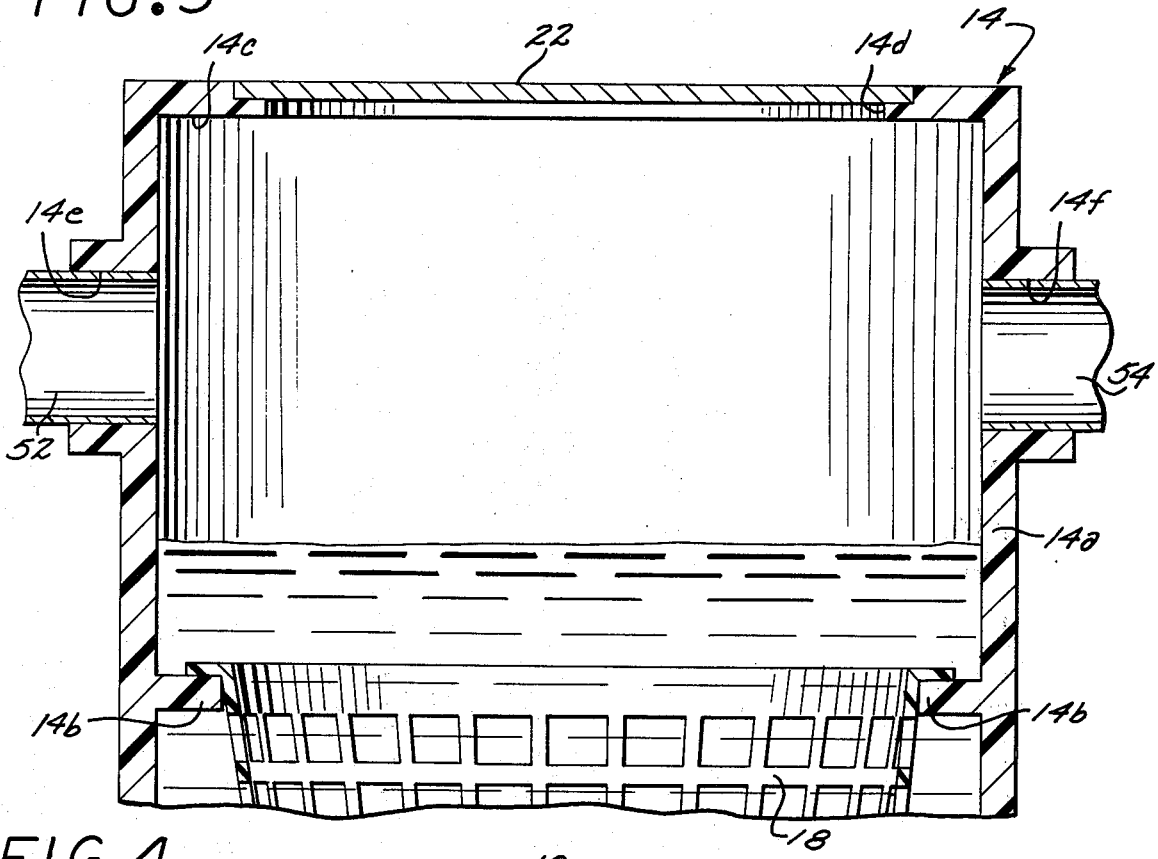
FIG. 3 is a fragmentary sectional view taken substantially along line 3—3 of FIG. 1.
Figure 4:
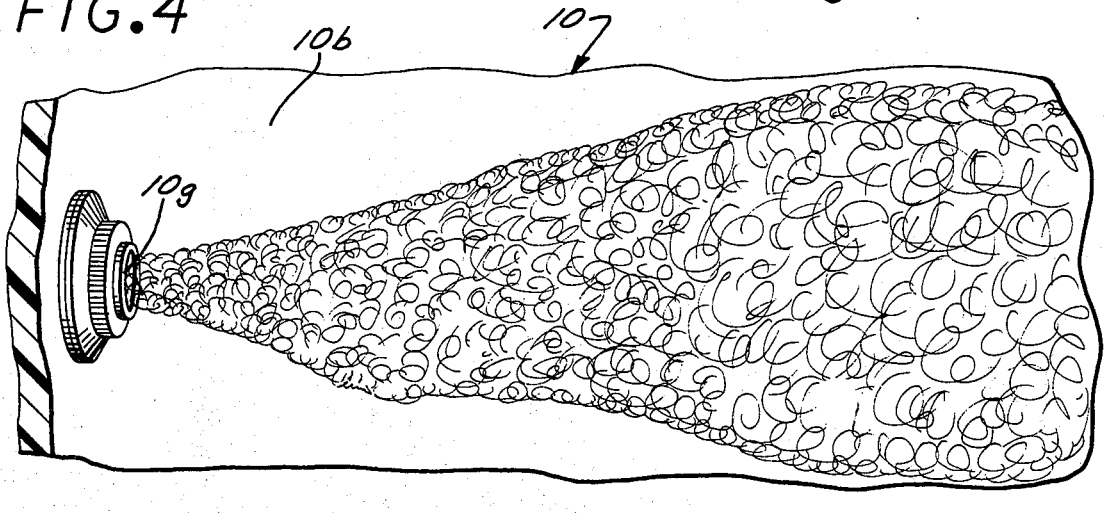
FIG. 4 is a fragmentary perspective view of a portion of the pool of FIG. 1, at location 4 therein.

Attached to the side of pool 10 or formed integrally therewith as desired, is a skimmer 14 which is shown most clearly in FIGS. 1 and 3 of the drawings. Such skimmer is attached to the side of pool 10 and an opening 10*k* is formed in the side wall 10*b* of the latter to facilitate the flow of surface fluid within the pool to the skimmer.

The outlet 10*f* is referred to as the main drain, and a pipe or conduit 16 connects such outlet to the skimmer 14. Thus, fluid flows into the skimmer from two sources, through the skimmer opening 10*k* as well as the main drain 10*f*.

As shown in FIG. 3 of the drawings, skimmer 14 comprises a housing 14*a* having an annular ledge 14*b* which provides a support for a filter basket 18. The housing 14*a* of skimmer 14 is so positioned on the side of pool 10 and relative to the fluid therein, that the fluid level within housing 14*a* is such as to provide an air chamber 14*c*. The lower portion of the housing 14*a* is connected to an outlet pipe 20.

As further shown in FIG. 3 of the drawings, the housing 14*a* of skimmer 14 is formed with a large access opening 14*d* in the top wall. A cover or lid 22 is provided therefor.

Conduit or pipe 20 is provided with a shut-off valve 24 which may be a gate valve or the like, an electrically energizable fluid pump 26, filter 28 and heater 30. These components are part of a fluid or water circulating system 32, and are usually positioned externally of the pool 10. Return lines or pipes 34, 36 and 38 are used to return the fluid to the pool 10.

A pipe 40 conducts return fluid from pipe 38 to the inlet 10*g* of pool 10. In like fashion, a pipe 42 conducts return fluid from pipe 36 to the inlet 10*h*, and a pipe 44 conducts return fluid to the inlet 10*j* of pool 10.

Figure 2:
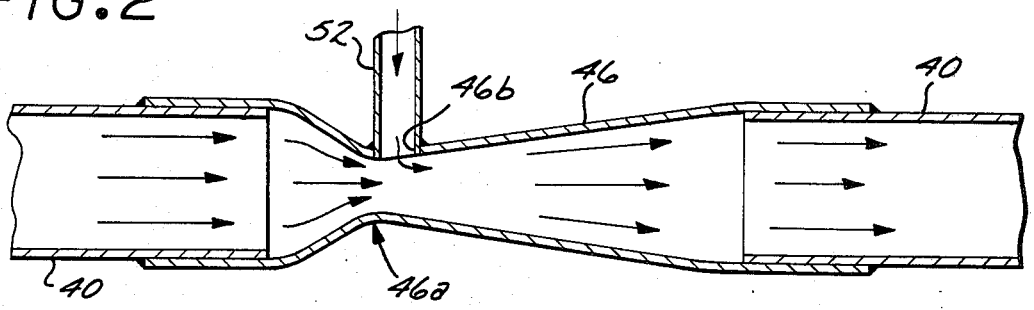
FIG. 2 is a fragmentary sectional view taken substantially along line 2—2 of FIG. 1.

Positioned in each of the return pipes 40, 42 and 44 is a venturi tube, as shown respectively at 46, 48 and 50. Such tubes are identical in construction and operation. Venturi tube 46, shown in detail in FIG. 2 of the drawings, is formed with a reduced portion 46*a* and an air inlet 46*b* thereat.

Referring to FIG. 3 of the drawings, the housing 14*a* of skimmer 14 is formed with a pair of outlet openings 14*e* and 14*f* in the side wall thereof above the fluid level therein. Opening 14*e* is connected to an air conduit or pipe 52 which, as shown most particularly in FIG. 1 of the drawings, is connected to the air inlet opening 46*b* of venturi tube 46.

Connected to opening 14*f* in the side wall of skimmer 14 is a conduit or pipe 54 which communicates with the air inlet opening of each of the venturi tubes 48 and 50 as shown.

This arrangement causes air to be drawn from the chamber 14*c* of skimmer housing 14*a* and conducted into the pool 10 through the respective inlets 10*g*, 10*h* and 10*j*. To accomplish this, pump 26 draws water from the pool 10 through skimmer outlet 10*k* and main drain 10*f*, and forces the same under pressure through filter 28, heater 30 and the various pipes and venturi tubes toward the respective inlets to pool 10. As the water is thus forced through the venturi tubes 47, 48 and 50, a decrease in pressure results at the narrow throat as shown at 46*a* with respect to venturi tube 46. This creates a pressure differential between the particular venturi tube and the air chamber 14*c* of the skimmer 14. As a result, the warm, moist air from the skimmer 14 is drawn into the venturi to be mixed therein with the water flowing into the pool under the force of pump 26. The air thus intermixed with the circulating fluid results in air bubbles which are warm and pleasant to the touch or feel. The pool inlets 10*g*, 10*h* and 10*j* are below the water line or fluid level in pool 10 thus providing a stream of warm air bubbles into the pool.

It is contemplated that the skimmer housing 14*a* may be formed with any appropriate fittings or openings for enabling the air to be drawn from above the water level therein. For instance, ordinary threaded pipe fittings can be employed, or suitable bonding means can be employed for fastening the pipes or conduits 52 and 54 within suitable openings therein. It is further contemplated that such connections could be made through the lid 22 on the top of the skimmer.

Within the context of the present invention, it is contemplated that in place of the aforedescribed venturi tubes for creating the necessary pressure differential for forcing the air into the stream of return water, suitable electrically operated pump means could be employed if this was desired. In such event, it is contemplated that the air inlets to the pool 10 could be separate and apart from the water inlets thereto, if desired. For instance, such air could be forced into the pool water through openings in the bottom or side walls as well as the seat 10*c* of pool 10.

It is thus seen that the present invention provides a therapeutic pool system for enabling warm air to be circulated into the pool water for reasons of comfort of the persons therein. Also, as the temperature of the water of pool 10 varies so does the temperature of the circulating air, due to the corresponding temperature variation of the water and air within skimmer 14. In addition, such air circulation system is sufficiently well-guarded so that suction noises and possible danger to individuals is minimized, if not avoided. In this regard, the air conduits or pipes in skimmer housing 14*a* constitute pressure relief means in the event of interference with the intake to the skimmer 14. Thus, rather than a small youngster being held against the skimmer intake due to the operation of a large pump 26, the air conduits 52 and 54 would relieve such pressure to permit the youngster to free himself. This is a desirable safety feature.

Although I have shown and described certain specific embodiments of my invention, I am well aware that many modifications thereof are possible.

I claim:

1. A therapeutic pool system comprising in combination, a pool to be filled with fluid to a predetermined level having a bottom wall and continuous side wall, and being formed with an outlet and an inlet, a circulation system for fluid in said pool comprising conduit means having a fluid pump therein and connected between said outlet and inlet, a skimmer in said circulation system comprising a housing adapted to be only partially filled with fluid circulating in said circulation system, means for heating the fluid in said pool and circulation system, one or more pipes connected to said housing above the level of fluid therein and to said pool below the level of fluid therein, and means in said pipes for creating a pressure drop along said pipes to cause air to be drawn into said pipes from above the fluid in said skimmer and to be discharged into said pool below the fluid level therein.

2. A therapeutic pool system according to claim 1, wherein said pressure drop means in said pipes comprises a venturi tube in said circulating system creating said pressure drop.

3. A therapeutic pool system according to claim 2, wherein said air from said skimmer housing is intermixed with said fluid in said venturi tube to be conducted therewith through the inlet of said pool.

* * * * *